United States Patent [19]

Shiffman

[11] Patent Number: 4,886,078

[45] Date of Patent: Dec. 12, 1989

[54] NAIL CLEANER

[76] Inventor: Jack Shiffman, 213 Copland Crescent, Saskatoon, Saskatchewan, Canada, S7H 2Z4

[21] Appl. No.: 63,309

[22] Filed: Jun. 17, 1987

[51] Int. Cl.[4] ..... A45D 29/00

[52] U.S. Cl. ..... 132/73; 15/159 A; 15/160

[58] Field of Search ..... 132/73, 73.5, 75.3; 604/1, 46, 289; 128/357, 757, 304; 15/159 A X, 160, 159 R

[56] References Cited

U.S. PATENT DOCUMENTS

| | | | |
|---|---|---|---|
| D. 116,216 | 8/1939 | Brekke | 132/73 |
| 792,471 | 6/1905 | Smith | 132/329 |
| 1,231,270 | 6/1917 | Knudsen | 132/73 |
| 1,234,844 | 7/1931 | Williams | 604/3 |
| 1,367,974 | 2/1921 | Ivory | 132/73 |
| 1,375,861 | 4/1921 | Sharp | 604/3 |
| 1,533,664 | 4/1925 | Sanford | 132/73 |
| 1,569,083 | 1/1926 | Frey | 132/73 |
| 1,819,004 | 8/1931 | Roessinger | 132/73 |
| 1,982,285 | 11/1934 | Bronner | 132/76.4 |
| 2,122,920 | 5/1938 | Russell | 132/89 |
| 2,191,721 | 2/1940 | Milarch | 15/160 |
| 2,480,446 | 8/1949 | Carlson | 132/73 |
| 3,097,386 | 7/1963 | Marani | 132/88.7 |
| 4,225,254 | 9/1980 | Holberg et al. | 401/119 |
| 4,452,262 | 5/1984 | Jankewitz | 132/88.5 |
| 4,624,273 | 11/1986 | Carr | 132/88.7 |

FOREIGN PATENT DOCUMENTS

| | | | |
|---|---|---|---|
| 2748343 | 5/1979 | Fed. Rep. of Germany | 132/89 |
| 2105188 | 3/1983 | United Kingdom | 132/73 |

*Primary Examiner*—John J. Wilson
*Assistant Examiner*—Adriene J. Lepiane
*Attorney, Agent, or Firm*—Irell & Manella

[57] ABSTRACT

An elongated rod or stick of porous material with one end pointed and tufted to engage under finger or toe nails for cleaning same. The porous material is impregnated with agents sueh as suitable soaps, detergents, germicides and the like actuated when the tufted tip is wetted with water. Materials such as orange wood, balsa, paper and the like may be used to form the stick and the tufted end thereon.

9 Claims, 1 Drawing Sheet

NAIL CLEANER

BACKGROUND OF THE INVENTION

This invention relates to new and useful improvements in finger or toenail cleaners, and although it is particularly adapted for use by operating personnel in hospitals and the like, nevertheless it can of course readily be adapted for use in other environments such as cosmetic, and by members of the general public in homes, restaurants, hotels and the like.

Insofar as operating personnel in hospitals are concerned, the general hand scrubbing procedure follows along similar lines and which in general consists of the personnel inspecting hands to ensure that their nails are short and free of polish, their cuticles are in good condition and that no cuts or skin problems exist.

The basic steps of the hand scrubbing procedure are as follows:

(1) Turn on the faucet and bring water to a comfortable temperature.

(2) Wet hands and arms.

(3) Using the foot conrol, dispense a few drops of Betadine (Trade Mark) soap into the palms. Add small amounts of water and make a lather.

(4) Wash hands and forearms to a level 2" above the elbows, under running water, clean fingernails with a nail pick.

(5) With a sterile brush and a Betadien soap, scrub first hand, including all aspects of the fingers. Do the palm and back of the hand up to the wrist. Scrub the nails under running water. This hand to take a total of 1 minute.

(6) Obtain another sterile brush and repeat procedure for 1 minute on second hand. If using a pre-op sponge use same method but using only one sponge. (This is because taking a second sponge would recontaminate your hands).

(7) With Betadine soap and warm water mechanically wash each arm for 1 minute moving from wrist to elbows. Rinse hands and arms, moving from finger tip to elbows. Always keep hands above the level of the elbows.

(8) Obtain more Betadine soap and so a 1 minute wash to hands. Rinse in the manner described above. Keeping hands higher than elbows, and in front of you, proceed to the theatre.

It will be noted that steps 4, 5 and 6 all refer to the cleaning and scrubbing of the finger nails using a nail pick and two sterile brushes or a pre-op sponge thereby stressing the importance of ths particular operation.

DESCRIPTION OF PRIOR ART

Prior art known to the applicant apart from plastic nail picks or orange sticks with sharpened ends, include the following U.S. Patents:

(1) U.S. Pat. No. 1,234,844, S. W. Williams, July 31, 1917. This shows a surgical swab adapted for transporting and applying small quantities of cleansing antiseptical healing liquid in a container and to dispense same through a fabric cover.

(2) U.S. Pat. No. 1,375,861, W. H. Schab, Aug. 26, 1921. This is similar in concept and construction to the previous patent both in construction and use.

(3) U.S. Pat. No. 1,819,004, W. C. Roessinger, Aug. 18, 1981 shows a pencil type toilet article for use in whitening the undersides of the nails and includes a relatively sharp pointed core within a casing of wood or wound paper stick.

(4) U.S. Pat. No. 1,982,285, F. J. Bronner, Nov. 24th, 1934. This shows a cleaning and polishing means for teeth and nails having wedge shaped or slanting receptacles or grooves adapted to receive pumice and the like and to hold same while cleaning said nails and teeth.

(5) U.S. Pat. No. 2,122,920, A. N. Russell, July 5th, 1938. This shows a dental stick formed of a composition containing a cementitious ingredient, a polish ingredient and a comminuted buffing and binding ingredient in the form of a stick.

(6) U.S. Pat. No. 4,225,254, Holberg et al, Sept. 30th, 1980, illustrates a scrub device for applying a selected liquid to an area of the body of a patient while maintaining the sterile condition required and is in the form of a hollow handle and a scrubbing swab on one end thereof.

(7) U.S. Pat. No. 4,452,262, Jankewitz, June 5th, 1984 illustrates a device for applying a coloring cosmetic substance incorporating a wick similar to a felt pen wick.

(8) U.S. Pat. No. 4,624,273, Carr, Nov. 25th, 1986 discloses a cosmetic pencil haing a core of water-set mixture of plaster of paris and the like with pigment and color surrounded by a casing and capable of being end sharpened similar to a pencil.

None of these is suitable for the purpose of antiseptically scrubbing under the fingernails whereas the present device is designed specifically for this purpose. It is manufactured from a natural or synthetic fibrous material such as orange wood, balsa wood or the like and is provided with an end portion which engages under the fingernail, terminating in a frayed or tufted tip which acts as a scrubber when the tip is moved back and forth under the fingernail. Paper products may also be used.

It may also be impregnated with a material such as a water soluble soap, detergent, antiseptic, anti-fungal or anti-bacterial agent or any other water soluble agent required so that when the tip is dipped in water, the agent is released and assists in the cleansing action generated by the tufted end being moved back and forth under the nail.

In accordance with the invention there is provided a nail cleaner comprising an elongated stick having at least one end portion formed from a fibrous material and having an under-nail-engaging tip end formed thereon, said tip end including a tuft of said fibrous material on said tip end to assist in scrubbing under the nail.

Such devices may be disposable after use or, for example when used in the home, may be re-used if desired.

Although the nail engaging end is preferably spatulate with the tufted portion extending right across the splayed end of the stick, nevertheless it will be appreciated that this end portion can be of any desired configuration which will engage under the finger or toe nail and which can scrub the area between the nail and the flesh in order to greatly reduce the microbial, bacterial or fungal environment normally present thereunder.

Because the tuft is more adaptable, it can reach into areas that a hard tipped scraping type implement cannot.

Another advantage of the invention is to provide a device of the character herewithin described which is simple in construction, economically manufactured and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
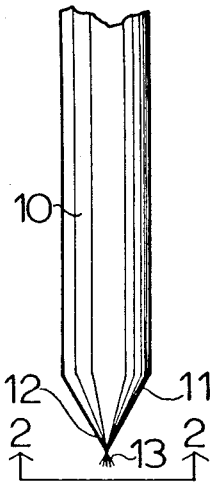
FIG. 1 is a front elevation of one emodiment.
Figure 2:
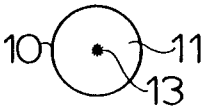
FIG. 2 is an underside end view of FIG. 1.

Proceeding therefore to describe the invention in detail, reference should first be made to FIG. 1 which shows an elongated member in the form of a stick 10 being end sharpened as at 11 in a conical form and being manufactured from a natural or synthetic fibrous material such as orange wood, balsa wood or the like.

The tip end portion 12 is formed in a tuft 13 caused by a splaying of the fibres forming the fibrous material.

At least the end portions 11 and 12 and the tuft 13 are preferably impregnated with a desired material such as water soluble soap, detergent, antiseptic, anti-fungal, anti-bacterial or antibiotic materials or may include a specific solvent for removal of specific debris. Most of these materials are preferably soluble in water so that it is only necessary to dip the end in water and it is ready for use with the impregnated material being available immediately.

Figure 3:
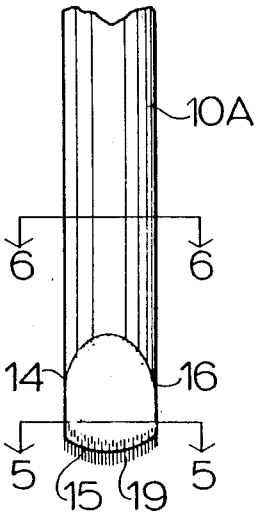
FIG. 3 is a front elevation of the preferred embodiment.

The preferred embodiment is shown in FIG. 3 which includes a cylindrical elongated member of stick 10A with the end portion 14 being spatulate and terminating with the tip end 15 in the form of a convex curve when viewed in front elevation.

Figure 4:
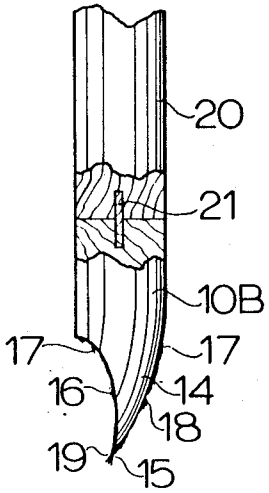
FIG. 4 is a side elevation of FIG. 3.
Figure 6:
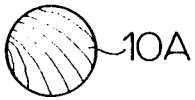
FIG. 6 is a cross-sectional view along the line 6—6 of FIG. 3.

FIG. 4 shows the preferred configuration of the end portion 14 with the front surface 16 extending downwardly from a point 17 to the tip end 15 in a concave curve.

The rear surface 18 also curves downwardly from the point 17 to the tip end 15 in a convex curve so that the junction between the surfaces 16 and 18 form the convex curve 15 shown in FIG. 3 and the tuft portion 19 extends around this convex curve 15 and extends therefrom.

It is also desirable that at least the lower ends of the surfaces 16 and 18 are formed with a fibrous or roughened surface to facilitate the scrubbing action when used under the nails in a transverse reciprocating motion.

Once again this end portion 14 may be impregnated with a water soluble material depending upon the area of use.

FIG. 4 also shows a still further alternative in which the fibrous stick portion 10B is replaceable within a holding portion 20 as for example by the provision of a screw threaded stud 21 extending upwardly from the upper end of the portion 10B and screw threadably engaging within the lower end of the portion 20, it being understood that the portion 20 may be of wood, metal or plastic as desired.

Figure 7:
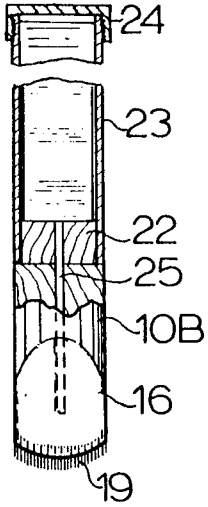
FIG. 7 is a fragmentary front elevation of an alternative construction of the embodiment of FIGS. 1, 3 and 5 showing a reservoir with a replacement tip end portion.

Still another embodiment is shown in FIG. 7 in which the portion 10B is similar to the portion 10B shown in FIG. 4 except that the upper end 22 of the portion 10B is screw threaded to engage within the screw threaded wall of the lower end of a reservoir 23 which may contain the necessary solution desired to be used with the tufted end 19. The reservoir may have a screw threaded cap 24 on the upper end thereof so that the liquid therein may be replenished.

The advantages of the nail cleaner include the fact that the tufted tip 13 or 19 allows for an actual scrubbing action under the nail instead of the usual scraping action of the common nail file or other types of implements presently in use and because the tuft is more adaptable, it can reach into areas that a hard tipped instrument cannot. This meansthat the tufted tip can remove a greater amount of debris from beneath the nail and when the scrubbing action is combined with water soluble soaps, detergents, antiseptics, anti-fungal or other medicaments, the microbial, bacterial or fungal environment under the nail will be greatly reduced.

Under certain circumstances, the addition of a whitener to the above will also improve the aesthetics of the finger or toenail to an even greater extent.

The nail cleaner, when combined or impregnated with the proper additives, as mentioned above, greatly improves the pre-operative scrub technique in hospital surgery and of course will also greatly improve the scrub technique in preparing patients for hand, finger, foot and toe surgery.

It is believed that the cleaner has universal use in as much as it can be used in hospitals, medical and dental offices, by podiatrists or chiropodists, manicurists, restaurant workers, workers in industry, hotels, home use and other miscellaneous locations.

From the above description it will also be appreciated that the nail cleaner, in any of its embodiments, may be used for a variety of conditions or can be produced for specific conditions including an anti-fungal material added for fungal infections, antibiotics if bacterial infections are present and specific solvents for the removal of specific debris, e.g., the removal of paint, inks, dyes and the like from under fingernails.

The tufted tip would be softer and less damaging to the tissue underlying the nail than hard tips presently available on nail files, plastic picks, or in sticks and the like and would also be more comfortable in use yet be far more efficient.

The addition of a topical anesthetic to the soft tufted tip would permit the application of a topical "freezing" under the nails for painful conditions such as "hangnails" or trauma of the "quick".

Referring back to FIG. 7, the reservoir for the fluid supply may have a tamponof fibre, sponge or cellulose to better hold and control the fluid flow through a drilling 25 to one roughened surface 16 of the end portion 14 and of course could be designed to accept refills for specific purposes. Although not shown, a cover or cap is readily designed to cover the tip in this particular embodiment.

Figure 5:
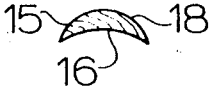
FIG. 5 is a cross sectional view substantiated along the line 5—5 of FIG. 3.

It will be noted from FIG. 5 that the cross-sectional configuration of the tip end portion shown in FIGS. 4, 5 and 7 is concave/convex thus fitting readily under the nail and allowing a scrubbing action of the underside of the nail, together with the flesh thereunder at the junction between the nail and the flesh. This configuration is effected by forming the transverse dimension of the surfaces 16 and 18 transversely concave and convex respectively and is a further modification to that shown in FIGS. 3, 4 and 7.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A nail cleaner comprising an elongated stick having at least one end portion formed from a rigid fibrous material and having an under-nail-engaging tip end formed thereon said tip end terminating in an end edge with a convex curvature across said tip end and a length substantially the same as the width of said end portion of said stick, a front surface of said tip end being concave and a rear surface of said tip end being convex, said surfaces meeting at the convexly curved end edge, said fibrous material being frayed at the tip end to provide a tuft of said fibrous material along said end edge to assist in scrubbing under the nail.

2. The cleaner according to claim 1 in which at least said tip end is impregnated with a water soluble material which will greatly reduce the bacterial, microbial and/or fungal environment under the nail under which it is used.

3. The cleaner according to claim 2 in which said water soluble material is selected from the group consisting of soap, detergent, antiseptic, anti-fungal, anti-microbial, and anti-bacterial agents.

4. The cleaner according to claim 3 which includes the addition of a topical anaesthetic.

5. The cleaner according to claim 2 wherein the fibrous material is wood.

6. The cleaner according to claim 5 wherein the wood is selected from the group consisting of orange and balsa woods.

7. The cleaner according to claim 1 where said fibrous material is wood.

8. The cleaner according to claim 7 wherein the wood is selected from the group consisting of orange and balsa woods.

9. A cleaner according to claim 1 including fibrous scrubbing surfaces on the stick adjacent the tip end.

* * * * *